US008622775B2

(12) United States Patent
Takashima et al.

(10) Patent No.: US 8,622,775 B2
(45) Date of Patent: Jan. 7, 2014

(54) CONNECTION STRUCTURAL BODY

(75) Inventors: Naoya Takashima, Tokyo (JP); Kengo Mitose, Tokyo (JP); Yukihiro Kawamura, Shiga (JP)

(73) Assignees: Furukawa Electric Co., Ltd., Tokyo (JP); Furukawa Automotive Systems Inc., Shiga (JP)

( * ) Notice: Subject to any disclaimer, the term of this patent is extended or adjusted under 35 U.S.C. 154(b) by 0 days.

(21) Appl. No.: 13/567,684

(22) Filed: Aug. 6, 2012

(65) Prior Publication Data

US 2013/0040511 A1 Feb. 14, 2013

Related U.S. Application Data

(63) Continuation of application No. PCT/JP2011/052402, filed on Feb. 4, 2011.

(30) Foreign Application Priority Data

Feb. 5, 2010 (JP) ..... 2010-024608
Feb. 5, 2010 (JP) ..... 2010-024609

(51) Int. Cl.
*H01R 13/02* (2006.01)

(52) U.S. Cl.
USPC ..... 439/886

(58) Field of Classification Search
USPC ..... 439/877, 886, 887
See application file for complete search history.

(56) References Cited

U.S. PATENT DOCUMENTS 2,655,641 A * 10/1953 Asaff ..... 439/874
2,806,215 A * 9/1957 Redslob ..... 439/868
2,815,497 A * 12/1957 Redslob ..... 439/203
2,869,103 A * 1/1959 Wells ..... 439/203
3,656,092 A * 4/1972 Swengel et al. ..... 439/730
3,955,044 A * 5/1976 Hoffman et al. ..... 174/84 C
4,214,121 A * 7/1980 Charneski et al. ..... 174/84 C
5,137,478 A * 8/1992 Graf et al. ..... 439/874

(Continued)

FOREIGN PATENT DOCUMENTS

JP 53-127694 A 11/1978
JP 07-135031 A 5/1995

(Continued)

OTHER PUBLICATIONS

International Search Report issued in PCT/JP2011/052402, mailed Mar. 8, 2011, 2 pages.

*Primary Examiner* — Ross Gushi
(74) *Attorney, Agent, or Firm* — Osha Liang LLP

(57) ABSTRACT

In a connection structural body, an aluminum electric wire tip part and a crimp terminal are connected to each other. The aluminum electric wire tip part is an exposed tip part of an insulated wire including an aluminum core wire and an insulating cover for covering the aluminum core wire. The crimp terminal includes a wire barrel section for pressure-bonding and thus connecting the aluminum electric wire tip part and is formed of a metal material having a higher potential than that of the aluminum core wire. The aluminum electric wire tip part is covered with a cover solder and/or a cover resin, pressure-bonded, and connected to the wire barrel section such that the aluminum electric wire tip part is covered with the cover and/or the cover resins, with no gap, from an insulating cover tip part to a rear end portion of the wire barrel section.

5 Claims, 8 Drawing Sheets

(56) References Cited

U.S. PATENT DOCUMENTS

| | | | | |
|---|---|---|---|---|
| 5,225,066 | A * | 7/1993 | Drew | 205/85 |
| 6,334,798 | B1 * | 1/2002 | Ushijima et al. | 439/879 |
| 6,538,203 | B1 * | 3/2003 | Nolle et al. | 174/84 R |
| 6,666,732 | B1 * | 12/2003 | Endacott | 439/874 |
| 7,174,633 | B2 * | 2/2007 | Onuma | 29/854 |
| 7,374,466 | B2 * | 5/2008 | Onuma et al. | 439/874 |
| 7,824,235 | B2 * | 11/2010 | Yang | 439/874 |
| 7,905,755 | B1 * | 3/2011 | Martauz | 439/877 |
| 7,954,235 | B2 * | 6/2011 | Martauz et al. | 29/855 |
| 7,960,652 | B2 * | 6/2011 | Drew et al. | 174/74 R |
| 8,245,396 | B2 * | 8/2012 | Kondo et al. | 29/863 |
| 8,266,798 | B2 * | 9/2012 | Martauz | 29/855 |
| 2010/0084159 | A1 * | 4/2010 | Drew et al. | 174/113 R |
| 2011/0070770 | A1 * | 3/2011 | Sakai | 439/521 |
| 2011/0070771 | A1 * | 3/2011 | Martauz | 439/524 |
| 2013/0008714 | A1 * | 1/2013 | Morikawa et al. | 174/74 R |
| 2013/0040509 | A1 * | 2/2013 | Mitose et al. | 439/877 |
| 2013/0040511 | A1 * | 2/2013 | Takashima et al. | 439/882 |
| 2013/0095708 | A1 * | 4/2013 | Mitose et al. | 439/878 |

FOREIGN PATENT DOCUMENTS

| | | | |
|---|---|---|---|
| JP | 2003-229192 | A | 8/2003 |
| JP | 2003-317817 | A | 11/2003 |
| JP | 2004-207172 | A | 7/2004 |
| JP | 2006-179369 | A | 7/2006 |
| JP | 2007-250393 | A | 9/2007 |
| JP | 2009-123622 | A | 6/2009 |
| JP | 2010-020980 | A | 1/2010 |
| JP | 2010-073638 | A | 4/2010 |

* cited by examiner

CONNECTION STRUCTURAL BODY

TECHNICAL FIELD

The present invention relates to a connection structural body using a crimp terminal attachable to, for example, a connector or the like for connection of a wire harness for an automobile; and in more detail, a connection structural body in which a wire harness formed of an aluminum electric wire or an aluminum alloy electric wire is connected to a crimp terminal.

BACKGROUND ART

Conventionally, for gasoline automobiles, a wire harness (or a battery cable) or the like for pressure-bonding and thus connecting a tin-plated copper terminal and a copper electric wire to each other is used. Since carbon dioxide emissions from automobiles are required to be reduced today, electric automobiles or hybrid automobiles using more wire harnesses than the gasoline automobiles are in a wider use.

For all the types of automobiles including gasoline automobiles, weight reduction of a vehicle significantly influences the fuel efficiency. In an attempt to reduce the weight, aluminum (or aluminum alloy) electric wires are used for the wire harnesses, battery cables and the like, as well as copper (or copper alloy) electric wires.

However, in the case where an aluminum electric wire formed of aluminum or an aluminum alloy is pressure-bonded and thus connected to a crimp terminal formed of copper or a copper alloy, when there is moisture such as condensed dew, seawater or the like between the electric wire and the crimp terminal, an electrochemical reaction occurs. Specifically, a phenomenon called "galvanic corrosion" that aluminum or the aluminum alloy having a low potential is corroded by contact with a metal material having a high potential used to form the crimp terminal such as tin plating, gold plating, a copper alloy or the like occurs.

Due to the galvanic corrosion, the aluminum electric wire pressure-bonded by a pressure-bonding section of the terminal is corroded, dissolved or extinguished. This raises the electric resistance, and may prevent the electric wire from having a sufficient conducting function.

For a connection structural body in which such an aluminum electric wire formed of aluminum or an aluminum alloy is connected to a crimp terminal formed of copper, a copper alloy or the like, the following connection structure has been proposed in order to prevent galvanic corrosion of the aluminum electric wire. A part of the aluminum electric wire which is exposed as a result of being stripped of an insulating cover is inserted into a terminal having a bottom with holes into which molten solder has been injected. The exposed part of the aluminum electric wire is caulked via the solder and thus pressure-bonded to the terminal (see Patent Document 1).

Galvanic corrosion does not occur due to an aluminum electric wire and a crimp terminal formed of the same type of material. However, in the connection structure described in Patent Document 1, a part of the aluminum electric wire from a tip of the insulating cover to a position at which the electric wire is inserted into the terminal is exposed and is not waterproof. Therefore, in the case where the crimp terminal is formed of brass, copper or the like, which is used conventionally, or in the case where there is solder, galvanic corrosion is likely to occur in the contact part of the aluminum electric wire and the crimp terminal or the soldered part of the aluminum electric wire due to difference in the ionization tendency of the materials.

As another measure against galvanic corrosion of the aluminum electric wire, more specifically as a measure to prevent galvanic corrosion when the electric wire and the metal fittings of the crimp terminal are formed of different metal materials, the following connection structure has been proposed. A part of the aluminum electric wire which is exposed as a result of being stripped of an insulating cover is covered with an intermediate cap formed of the same type of copper alloy as that of the crimp terminal, and a caulking piece is caulked to enclose the intermediate cap, thus to pressure-bond and thus fix the aluminum electric wire to the crimp terminal (see Patent Document 2).

However, the connection structure described in Patent Document 2 is for use in thick electric wires such as, for example, electric wires for electric power used for electric automobiles, and is difficult to be applied to thin electric wires. This connection structure also requires many components such as special members, an intermediate cap of a specific shape, elastic members and the like, and the work of inserting the components is complicated. For these reasons, the connection structure described in Patent Document 2 is disadvantageous in terms of cost.

CITATION LIST

Patent Literature

Patent Document 1: Japanese Laid-Open Patent Publication No. 2006-179369

Patent Document 2: Japanese Laid-Open Patent Publication No. 2004-207172

SUMMARY OF INVENTION

Technical Problem

The present invention has an object of providing a connection structural body in which an electric wire and a crimp terminal formed of different metal material are connected to each other, and which is produced at low cost and with a small number of production steps, prevents galvanic corrosion, and has a conducting function with certainty.

Solution to Problem

The present invention is directed to a connection structural body, comprising an aluminum electric wire tip part and a crimp terminal which are connected to each other. The aluminum electric wire tip part is an exposed tip part of an insulated wire including an aluminum electric wire and an insulating cover for covering the aluminum electric wire, and is exposed as a result of being stripped of a tip part of the insulating cover. The crimp terminal includes a wire barrel section for pressure-bonding and thus connecting the aluminum electric wire tip part, and is formed of a metal material having a higher potential than that of a metal material used to form the aluminum electric wire. The aluminum electric wire tip part is covered with a cover member formed of a metal material or formed of the metal material and a resin. The aluminum electric wire tip part is pressure-bonded and thus connected to the wire barrel section, such that the aluminum electric wire tip part is, in a pressure-bonded state, covered with the cover member, with no gap, from the tip part of the insulating cover to a rear end portion of the wire barrel section.

In the case of, for example, a crimp terminal including a wire barrel section and an insulation barrel section, a part thereof from the insulating cover tip part to the rear end portion of the wire barrel may be a transition section between the wire barrel section and the insulation barrel section.

The aluminum electric wire may be formed by twisting aluminum core wires, aluminum alloy core wires, or copper-covered aluminum core wires.

The metal material having a high potential which is used for forming the crimp material may be, for example, a metal material, such as copper, tin or the like, which has a lower degree of ionization tendency than that of the aluminum electric wire, or a metal material plated with a metal material having a high potential.

The metal material used for forming the cover member may be solder, or copper or the like usable to cover the aluminum electric wire.

The resin may be a hot-melt-type resin such as a polyamide-based resin, an ester-based resin or the like; a thermosetting resin such as a silicone-based resin, a fluorine-based resin or the like; or a UV-curable resin such as an epoxy-based phenol novolac-type resin, an epoxy-based bisphenol A-type resin.

According to the present invention, a connection structural body which is produced at low cost and with a small number of production steps, prevents galvanic corrosion, and has a conducting function with certainty can be provided even when the aluminum electric wire is pressure-bonded and thus connected to a crimp terminal formed of a metal material having a higher potential than that of the metal material used to form the aluminum electric wire.

In more detail, the aluminum electric wire tip part stripped of the insulating cover of the insulated wire is covered with the cover member. Therefore, the aluminum electric wire tip part which is exposed from the insulated wire is prevented from being exposed to moisture such as waterdrops or the like, at low cost and with a small number of steps.

When the cover member enters the inside of the wire barrel section, contact of the moisture and the aluminum electric wire can be prevented more certainly, and thus galvanic corrosion can be prevented or suppressed. When the resin permeates to a position around the center of the wire barrel section, a sufficient mechanical strength and a sufficient electrical strength are provided even when the resin is used as the cover member.

It is more preferable that the crimp terminal is formed of, for example, solder, which is a metal material similar to the above-mentioned metal material having a high potential, such as tin or the like used to plate a metal plate for forming the crimp terminal. In this case, the effect of preventing galvanic corrosion is improved.

The aluminum electric wire is pressure-bonded by the wire barrel section and the cover member is present between the wire barrel section and the aluminum electric wire. Therefore, a mechanically strong connection can be provided. The wire barrel section included in the crimp terminal is usable for electric wires of a wide range of diameter, including thick electric wires such as battery cables or the like through which a large amount of current can flow and thin electric wires through which a small amount of current can flow.

In an embodiment of the present invention, the aluminum electric wire may be formed of a copper-covered aluminum electric wire. The cover member may be formed of solder or formed of the solder and the resin, and the aluminum electric wire tip part may be covered with copper and with the solder and/or the resin, with no gap, in a pressure-bonding state.

According to the present invention, even when the aluminum electric wire is pressure-bonded and thus connected to a crimp terminal formed of a metal material having a higher potential than that of the metal material used to form the aluminum electric wire, generation of galvanic corrosion can be prevented more certainly and a conducting function can be provided with certainly.

In an embodiment of the present invention, the metal material may be formed of solder.

According to the present invention, the cover member is formed of solder or formed of the solder and a resin. Therefore, the aluminum electric wire can be easily covered with the cover member. Thus, a connection structural body preventing galvanic corrosion and having a conducting function with certainly can be provided at low cost and with a small number of production steps.

In an embodiment of the present invention, the cover member may permeate into the aluminum electric wire inside the insulating cover.

The inside of the insulating cover is in a part which is rearward with respect to the aluminum electric wire tip part exposed as a result of being stripped of the insulating cover, and is inner with respect to the tip of the remaining insulating cover. More specifically, the inside of the insulating cover refers to an area between the aluminum electric wire and the insulating cover and also an area among wire components of the aluminum electric wire inside the insulating cover, in the above-mentioned part.

According to the present invention, the water-proof effect provided by the cover member can be improved. In more detail, the aluminum electric wire is covered with a cover member formed of solder or a resin, and the solder or the resin permeates into the inside of the insulating cover. Therefore, a highly water-proof structure can be provided at low cost. Thus, galvanic corrosion of the aluminum electric wire can be prevented more certainly.

It is desirable that the cover member permeating into the inside of the insulating cover is a resin. In this case, when the resin also covers the outer surface of the insulating cover, the water-proof effect is improved.

In an embodiment of the present invention, the resin may be formed of a hot-melt-type resin having a kinematic viscosity of 5000 to 20000 mPa·s at or in the vicinity of melting point of the solder.

According to the present invention, the resin can be used as a cover member easily and securely. In more detail, when a hot-melt-type resin which is melted at the melting point of solder is used, the heat generated for soldering the aluminum electric wire tip part is used so that the aluminum electric wire tip part can be covered with the solder and the resin in one step. The hot-melt-type resin has a kinetic viscosity of 5000 to 20000 mPa·s at or in the vicinity of the melting point of solder. Therefore, the resin melted by the heat of soldering is closely bonded to the solder and the aluminum electric wire tip part before being solidified. Thus, the aluminum electric wire can be fixed with certainty without the resin being dropped.

In an embodiment of the present invention, a barrel piece included in the wire barrel section may be a curve-edged barrel piece having a convexed curve along an edge thereof.

The curve-edged barrel piece having a convexed curve along an edge thereof may be, for example, a semicircular barrel piece having a semicircular curve along an edge thereof.

In the case where the barrel piece of the wire barrel of the crimp terminal is rectangular, when the aluminum electric wire tip part covered with a cover member formed of solder or a resin is pressure-bonded to the wire barrel section, the cover member may possibly be cracked by the barrel piece of the wire barrel section. When this occurs, moisture may permeate into the aluminum electric wire tip part inside the cover member, which may cause galvanic corrosion of the aluminum electric wire.

Since the present invention prevents the cover member from being cracked, the galvanic corrosion of the aluminum electric wire due to the cracking of the cover member can be prevented.

Advantageous Effects of Invention

The present invention provides a connection structural body in which an electric wire and a crimp terminal formed of different metal material are connected to each other, and which is produced at low cost and with a small number of production steps, prevents galvanic corrosion, and has a conducting function with certainty.

DESCRIPTION OF EMBODIMENTS

An embodiment of the present invention will be described with reference to the drawings.

Figures 1A, 1B:
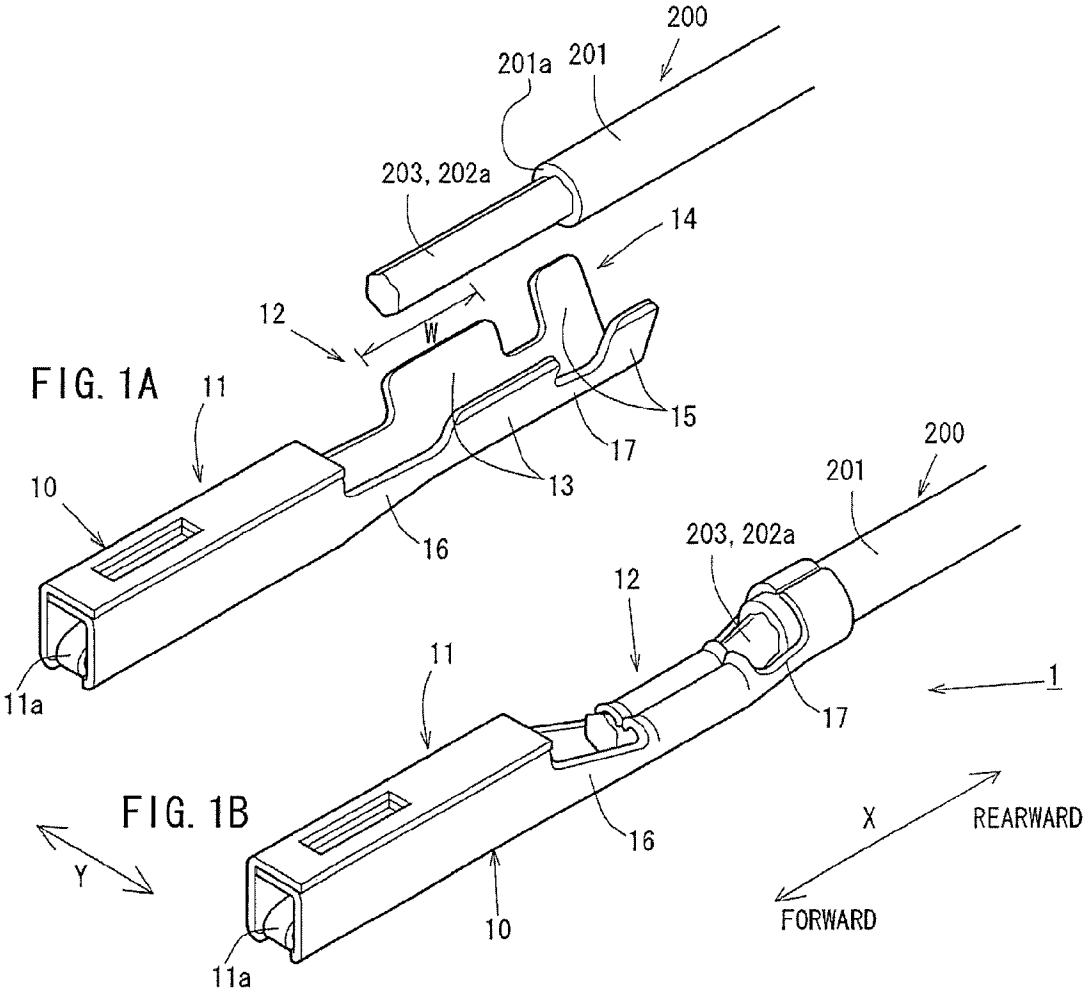
FIG. 1 shows a crimp terminal and a connection structural body in a first pattern.
Figure 2B:
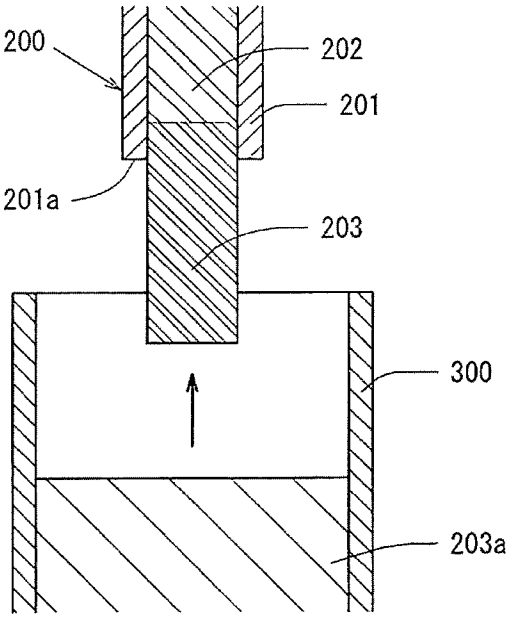
FIG. 2 shows a covering method using solder for the first pattern.
Figure 2A:
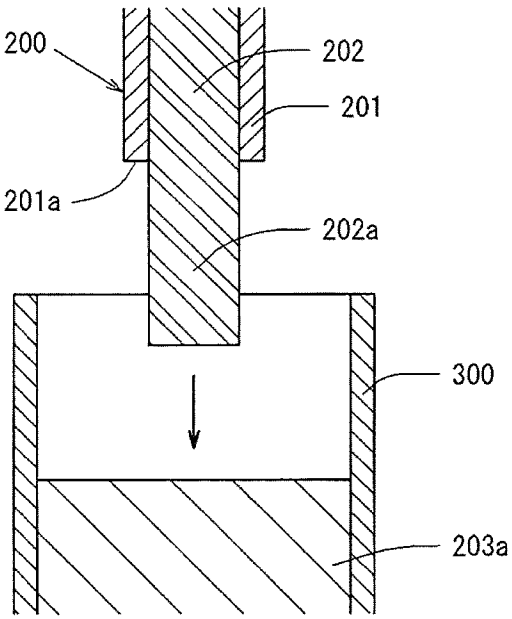

FIG. 1 shows a crimp terminal 10 and a connection structural body 1 in a first pattern. FIG. 2 shows a covering method using solder for the first pattern. FIG. 2(*a*) shows a state before a tip part of an insulating cover 201 is stripped off and an aluminum electric wire tip part 202*a* is immersed in molten solder 203*a* in a solder bath 300. FIG. 2(*b*) shows a state where the aluminum electric wire tip part 202*a* is immersed in the molten solder 203*a* in the solder bath 300 and is covered with cover solder 203.

Figures 3A, 3B:
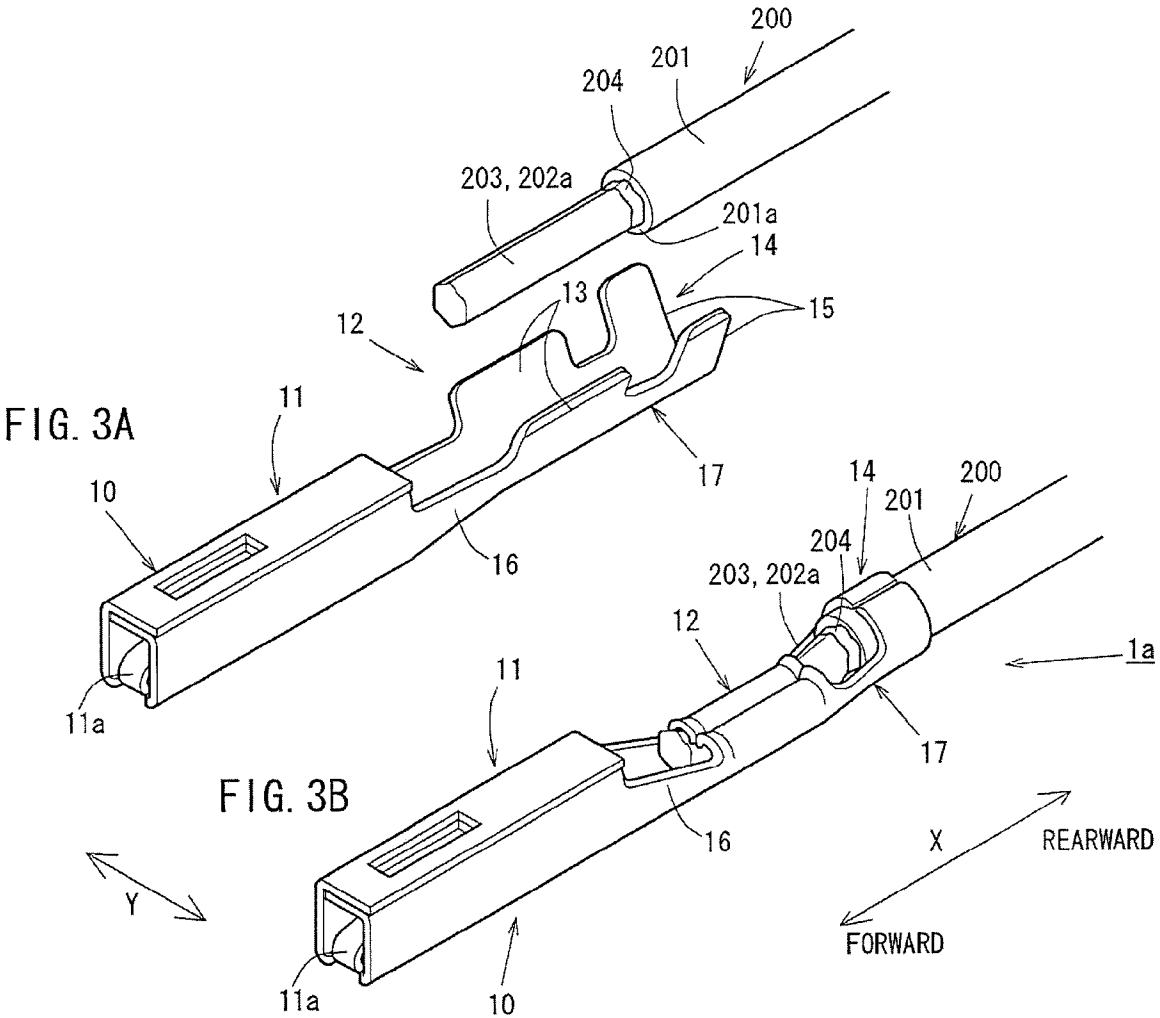
FIG. 3 shows a crimp terminal and a connection structural body in a second pattern.
Figure 4B:
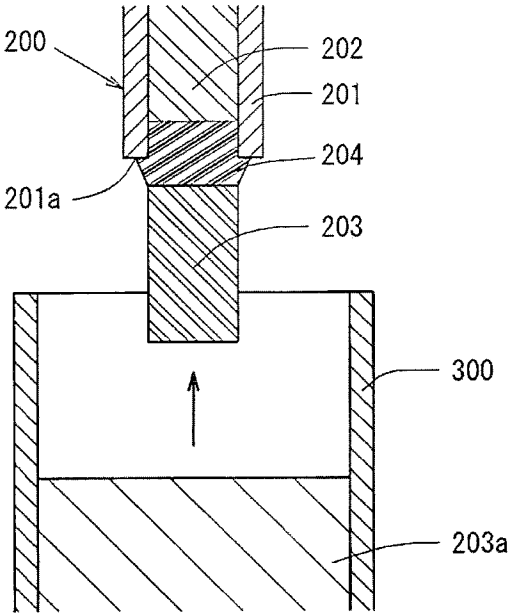
FIG. 4 shows a covering method using solder for the second pattern.
Figure 4A:
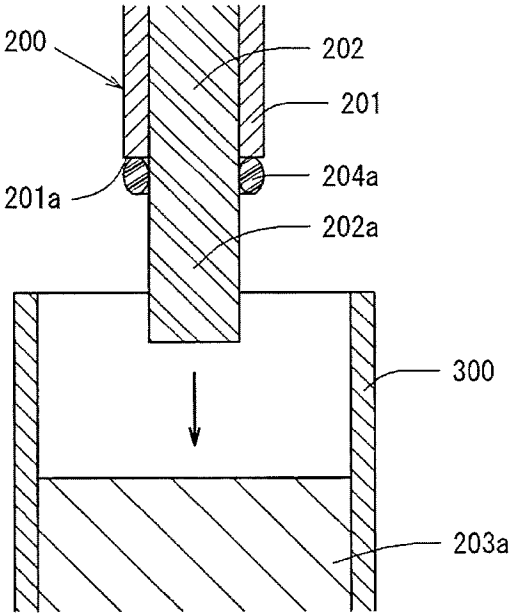
Figure 5A:
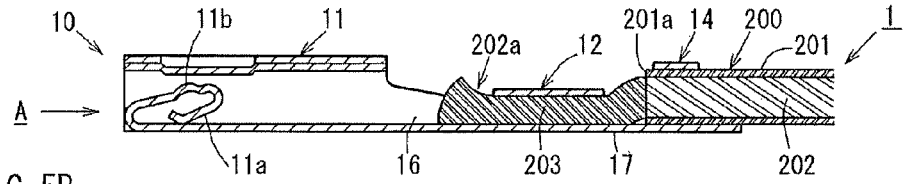
FIG. 5 provides cross-sectional views of connection structural bodies in different patterns.
Figure 5B:
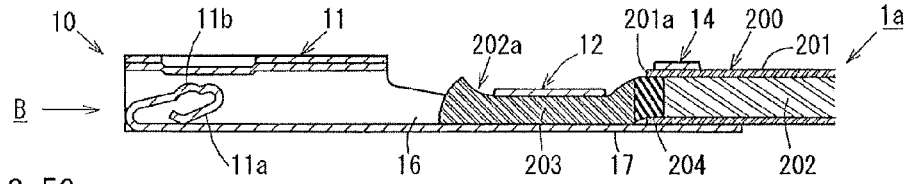
Figure 5C:
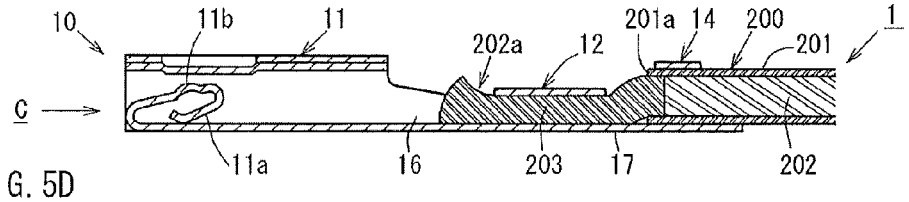
Figure 5D:
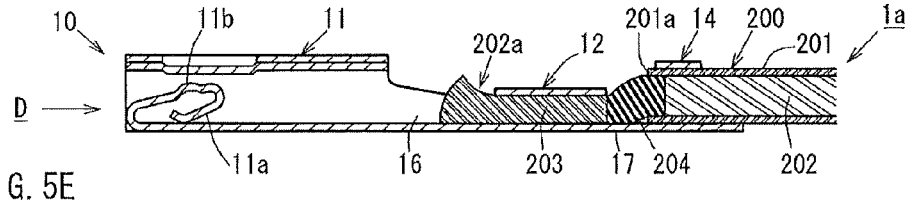
Figure 5E:
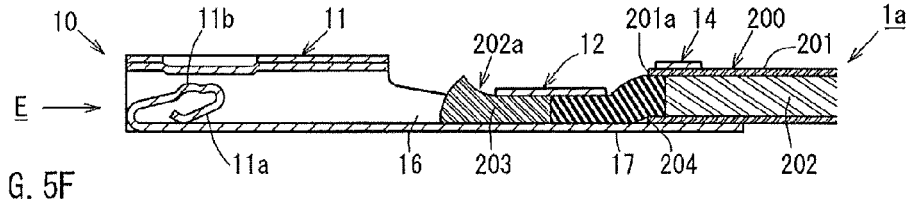
Figure 5F:
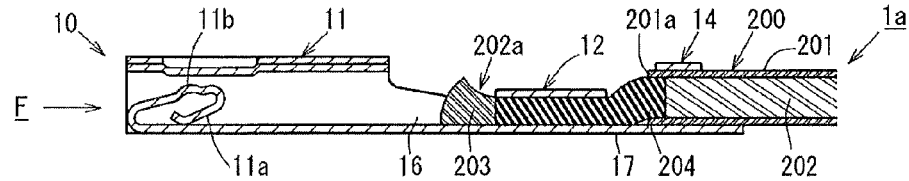
Figure 6A:
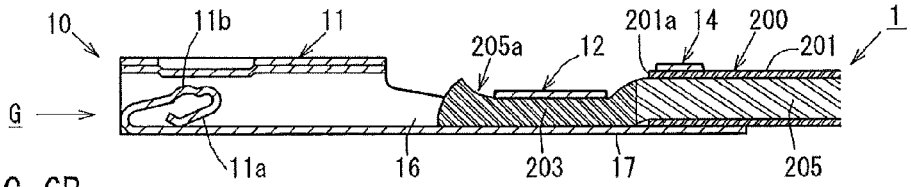
FIG. 6 provides cross-sectional views of connection structural bodies in different patterns.
Figure 6B:
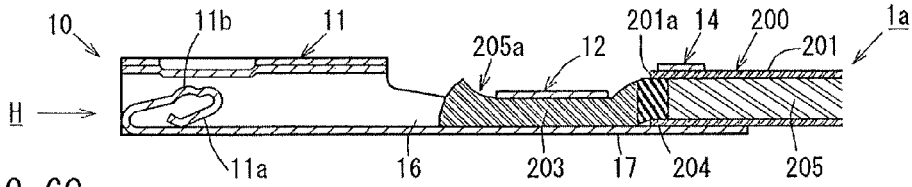
Figure 6C:
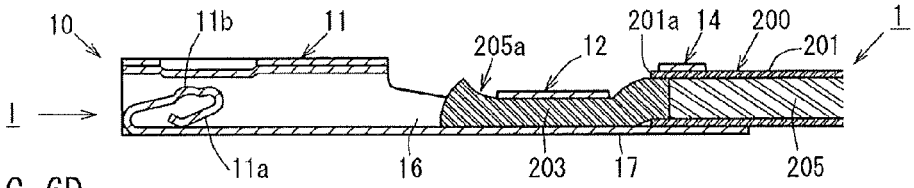
Figure 6D:
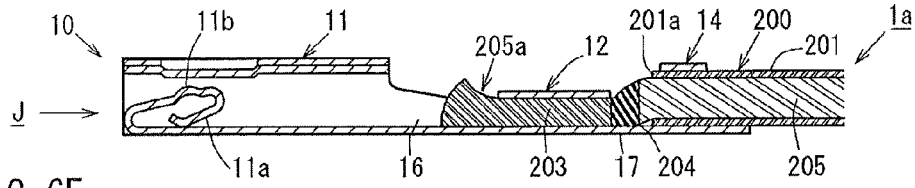
Figure 6E:
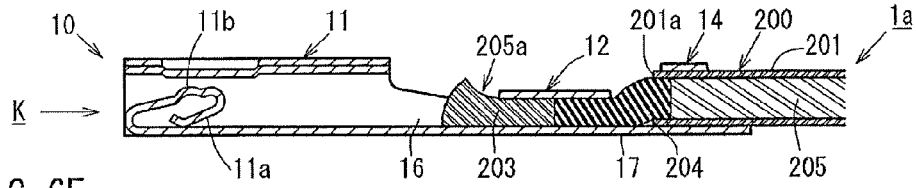
Figure 6F:
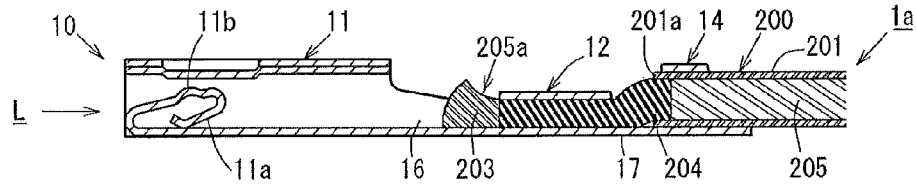

FIG. 3 shows a crimp terminal 10 and a connection structural body 1 in a second pattern. FIG. 4 shows a covering method using solder for the second pattern. FIG. 4(*a*) shows a state before a tip part of the insulating cover 201 is stripped off and the aluminum electric wire tip part 202*a* is immersed in the molten solder 203*a* in the solder bath 300. FIG. 4(*b*) shows a state where the aluminum electric wire tip part 202*a* is immersed in the molten solder 203*a* in the solder bath 300 and is covered with the cover solder 203 and a cover resin 204.

FIGS. 5 and 6 respectively show cross-sectional views of crimp terminals 10 of various patterns.

First, the crimp terminal 10 in the first pattern will be described. The crimp terminal 10 is of a female type, and includes, from a forward end to a rearward end in a longitudinal direction X thereof, a box section 11 for allowing insertion of a male tab of a male terminal (not shown), a wire barrel section 12 located rearward to the box section 11 with a first transition 16 of a prescribed length interposed therebetween, and an insulation barrel section 14 located rearward to the wire barrel section 12 with a second transition 17 of a prescribed length interposed therebetween. These elements are integrally formed.

The wire barrel section 12 caulks and thus pressure-bonds an aluminum core wire 202 of an insulated wire 200, and the insulation barrel section 14 caulks and thus fixes the insulating cover 201 of the insulated wire 200. Thus, the connection structural body 1 is formed.

The crimp terminal 10 is an open barrel-type terminal which is formed as follows. A copper alloy strip formed of brass or the like having a tin-plated surface is formed into a desired shape and bent to be three-dimensional. The box section 11 is formed of an inverted hollow quadrangular prism. The box section 11 accommodates a contact piece 11*a* which is bent rearward in the longitudinal direction X and has a contact convex section 11*b*, which is to be in contact with the male tab of the male terminal to be inserted.

As shown in FIG. 1(*a*), the wire barrel section 12 in a pre-pressure-bonding state includes wire barrel pieces 13 extending in oblique outer upper directions from both sides of a barrel bottom section in a width direction Y. The wire barrel section 12 is U-shaped when seen in a rear view, and is generally rectangular when seen in a side view.

Similarly, the insulation barrel section 14 in a pre-pressure-bonding state includes insulation barrel pieces 15 extending in oblique outer upper directions from both sides of a barrel bottom section in the width direction Y. The insulation barrel section 14 is U-shaped when seen in a rear view.

The insulated wire 200 is formed as follows. Along with the recent trend for reduced size and weight, the aluminum core wire 202 is formed by twisting extra fine aluminum wires, which are thinner than the conventional twisted wires. The aluminum core wire 202 is covered with the insulating cover 201 formed of an insulating resin.

In more detail, the aluminum core wire 202 is formed by twisting aluminum alloy wires such that the aluminum core wire 202 has a cross-sectional area size of 0.75 $mm^2$.

Apart of the insulating cover 201 covering a tip part of the aluminum core wire 202 is stripped off to expose the aluminum electric wire tip part 202*a*. The aluminum electric wire tip part 202*a* is covered with the cover solder 203. For the cover solder 203, Sn—Zn solder or the like, which is easily agreeable with aluminum, is used. As shown in FIG. 2, the aluminum electric wire tip part 202*a* is immersed in the solder bath 300 containing the molten solder 203*a* of a temperature of about 300° C. Thus, the cover solder 203 is attached to the aluminum electric wire tip part 202*a*.

In this case, it is desirable that the cover solder 203 has a thickness with which the cover solder 203 is not cracked by being pressure-bonded by the wire barrel pieces 13. For soldering, the aluminum electric wire tip part 202*a* may be immersed in the molten solder 203*a* which is vibrated by ultrasonic waves.

As described above, the aluminum electric wire tip part 202*a* is immersed in the molten solder 203*a* to be soldered. Therefore, because of a capillary phenomenon caused between wire components of the aluminum core wire 202, the molten solder 203*a* permeates into the inside of the insulating cover 201 from an insulating cover tip part 201*a* of the insulating cover 201 (see FIG. 2(*b*)).

The aluminum electric wire tip part 202*a* covered with the cover solder 203 in this manner is caulked by the wire barrel section 12, and the insulating cover 201 is caulked by the insulation barrel section 14. Thus, the connection structural body 1 including the crimp terminal 10 and the insulated wire 200 which are pressure-bonded and thus connected to each other with an electric connection strength and a mechanical connection strength is formed.

The aluminum electric wire tip part 202*a* may be pressure-bonded and thus connected to the wire barrel section 12 by caulking before the cover solder 203 is completely solidified.

Now, a connection structural body 1*a* in which the aluminum electric wire tip part 202*a* is covered with a combination of the cover solder 203 and the cover resin 204 will be described.

The crimp terminal 10, the insulated wire 200 and the cover solder 203 used in the connection structural body 1*a* are the same as those of the connection structural body 1 and will not be described in detail. As the cover resin 204, a hot-melt-type resin having a kinematic viscosity of 5000 to 20000 mPa·s at or in the vicinity of the melting point of the cover solder 203 is used.

Instead of the hot-melt-type resin, a thermosetting resin or a UV-curable resin is usable as the cover resin 204. Specifically, as the hot-melt-type resin, a polyamide-based resin having a viscosity of 6250 mPa·s at 225° C., an ester-based resin having a viscosity of 6300 mPa·s at 190° C. or the like is usable, for example.

A thermosetting resin having a viscosity of 500 to 10000 mPa·s immediately before being cured, for example, a silicone-based resin having a viscosity of 2500 mPa·s at 23° C., a fluorine-based resin having a viscosity of 4300 mPa·s at room temperature or the like is usable.

A UV-curable resin having a viscosity of 500 to 10000 mPa·s before being cured, for example, an epoxy-based phenol novolac-type resin having a viscosity of 5800 mPa·s before being irradiated with UV light, an epoxy-based bisphenol A-type resin having a viscosity of 8000 mPa·s before being irradiated with UV light, or the like is usable.

First, in order to cover the aluminum electric wire tip part 202*a* with a combination of the cover solder 203 and the cover resin 204, as shown in FIG. 4(*a*), the cover resin 204 in a ring shape is outserted onto an outer surface of the aluminum electric wire tip part 202*a* so as to contact the insulating cover tip part 201*a*.

The aluminum electric wire tip part 202*a* is immersed in the solder bath 300 until the ring-shaped cover resin 204 contacts the molten solder 203*a* in the solder bath 300. As a result, the cover solder 203 is attached to the aluminum electric wire tip part 202*a*, and the cover resin 204 heated by the molten solder 203*a* is melted and attached to the aluminum electric wire tip part 202*a*. In this manner, the aluminum electric wire tip part 202*a* can be covered in the state where the cover solder 203 and the cover resin 204 permeates into an area of the insulating cover 201 inner with respect to the insulating cover tip part 201*a*.

It is not absolutely necessary that the aluminum electric wire tip part 202*a* is immersed in the solder bath 300 until the ring-shaped cover resin 204 contacts the molten solder 203*a* in the solder bath 300. Alternatively, the aluminum electric wire tip part 202*a* may be immersed in the molten solder 203*a* down to a position at which the cover resin 204 is melted by the heat of the molten solder 203*a* which has permeated into the aluminum electric wire tip part 202*a*.

In the case where a thermosetting resin is used as the cover resin 204, the aluminum electric wire tip part 202*a* is covered as follows. The cover resin 204 in a liquid phase is applied to an edge of the insulating cover tip part 201*a*, and the aluminum electric wire tip part 202*a* is immersed in the solder bath 300 until the cover resin 204 contacts the molten solder 203*a* in the solder bath 300. Thus, the cover solder 203 is attached to the aluminum electric wire tip part 202*a*, and the cover resin 204 is thermally cured by the heat of the molten solder 203*a*. In this manner, the aluminum electric wire tip part 202*a* is covered with the cover solder 203 and the cover resin 204.

In the case where a UV-curable resin is used as the cover resin 204, the aluminum electric wire tip part 202*a* is covered as follows. First, the aluminum electric wire tip part 202*a* is immersed in the molten solder 203*a* in the solder bath 300 down to a position slightly away from the insulating cover tip part 201*a*. Thus, the aluminum electric wire tip part 202*a* is covered with the cover solder 203 to the position slightly away from the insulating cover tip part 201*a*.

Then, the UV-curable resin is applied to an exposed part of the aluminum electric wire tip part 202*a* which is between the part covered with the cover solder 203 and the insulating cover tip part 201*a*, and the UV-curable resin is cured by UV light. In this manner, the aluminum electric wire tip part 202*a* is covered with the cover solder 203 and the cover resin 204.

The aluminum electric wire tip part 202*a* covered with the cover solder 203 and the cover resin 204 in this manner is caulked and thus pressure-bonded by the wire barrel pieces 13 of the wire barrel section 12, and the insulating cover 201 is caulked and thus pressure-bonded by the insulation barrel pieces 15 of the insulation barrel section 14. Thus, the connection structural body 1*a* including the crimp terminal 10 and the insulated wire 200 which are pressure-bonded and thus connected to each other with an electric connection strength and a mechanical connection strength is formed.

The connection structural body 1*a* in which the aluminum electric wire tip part 202*a* is covered with the cover solder 203 and the cover resin 204 may be formed as follows. As described above, the aluminum electric wire tip part 202*a* is immersed in the molten solder 203*a* in the solder bath 300 down to a position slightly away from the insulating cover tip part 201*a*, and thus the aluminum electric wire tip part 202*a* is covered with the cover solder 203 to the position slightly away from the insulating cover tip part 201*a*. Then, the aluminum electric wire tip part 202*a* is pressure-bonded and thus connected to the crimp terminal 10. After this, a UV-curable resin is applied to the second transition 17 between the wire barrel section 12 and the insulation barrel section 14, and the UV-curable resin is cured by UV light. In this manner, the connection structural body 1*a* in which the aluminum electric wire tip part 202*a* is covered with the cover solder 203 and the cover resin 204 is formed.

In the above-described connection structural bodies 1 and 1*a*, the aluminum core wire 202 formed of an aluminum alloy and the crimp terminal 10 formed of a tin-plated copper alloy are pressure-bonded and thus connected to each other. Nonetheless, the aluminum electric wire tip part 202*a* is covered with the cover solder 203 and/or the cover resin 204 having substantially the same degree of ionization tendency as that of the tin-plated copper alloy, and is pressure-bonded and thus connected by the wire barred pieces 13. Therefore, galvanic corrosion is not caused due to the aluminum electric wire tip part 202*a* and the wire barred pieces 13. Thus, the connection structural bodies 1 and 1*a* have a conducting function with certainty.

In the connection structural bodies 1 and 1*a*, the cover solder 203 and/or the cover resin 204 covering the aluminum electric wire tip part 202*a* has a thickness with which the cover solder 203 and/or the cover resin 204 is not cracked by being caulked by the wire barrel pieces 13. Therefore, the connection structural bodies 1 and 1*a* have a mechanical connection strength.

For the connection structural bodies 1 and 1*a* having such a conducting function with certainty and also having a mechanical connection strength, the aluminum electric wire tip part 202*a* stripped of the insulating cover 201 is immersed in the molten solder 203*a* in the solder bath 300. Thus, the aluminum electric wire tip part 202*a* is easily covered with the cover solder 203 and/or the cover resin 204.

An effect confirming test was performed on the connection structural bodies 1 and 1*a* which had an electric strength and a mechanical strength and were formed easily. The effect confirming test will be described. For the effect confirming test, test bodies A through L regarding the connection structural bodies 1 and 1*a* and comparative test bodies A through C were produced. The connection structural bodies 1 and 1*a* each have a structure in which the insulated wire 200 is connected to the crimp terminal 10 by pressure-bonding. The insulated wire 200 is processed as follows. The aluminum core wire 202 having a composition of ECAI (aluminum alloy wire material for power transmission cables defined by JIS A1060 or A1070) is covered with the insulating cover 201, and a tip of the insulating cover 201 is stripped off to expose a tip part of the aluminum core wire 202. The exposed part is the aluminum electric wire tip part 202*a*.

The aluminum core wire 202 is pressure-bonded to the crimp terminal 10 only at one end thereof, i.e., at the aluminum electric wire tip part 202*a*. The opposite end of the aluminum core wire 202 is stripped of the cover 201 by a length of 10 mm, and is immersed in a solder bath for aluminum (produced by Nihon Almit Co., Ltd.; T235, using flux) to solder a surface of the aluminum core wire 202. Thus, the resistance of the contact point with the probe at the time of measurement of the electric resistance is minimized. The crimp terminal 10 is formed by bending a metal plate, specifically, 0.25 mm-thick brass metal plate having a tin-plated surface, into a three-dimensional shape.

Test body A shown in FIG. 5(*a*) has the following structure. The aluminum electric wire tip part 202*a* exposed as a result of being stripped of the insulating cover 201 is covered with the cover solder 203, and is pressure-bonded and thus connected to the crimp terminal 10.

Test body B shown in FIG. 5(*b*) has the following structure. The aluminum electric wire tip part 202*a* is covered with the cover solder 203 and the cover resin 204, and is pressure-bonded and thus connected to the crimp terminal 10. The cover resin 204 permeates into an area inner with respect to the insulating cover tip part 201*a*, and covers the aluminum electric wire tip part 202*a* to a position around the center of the second transition 17.

Test body C shown in FIG. 5(*c*) is similar to test body A, except that the cover solder 203 permeates into an area inner with respect to the insulating cover tip part 201*a*. Test body D shown in FIG. 5(*d*) is similar to test body B, except that the cover resin 204 covers the aluminum electric wire tip part 202*a* to a border position between the wire barrel section 12 and the second transition 17.

Test body E shown in FIG. 5(*e*) is similar to test body B, except that the cover resin 204 covers the aluminum electric wire tip part 202*a* to a position around the center of the wire barrel section 12. Test body F shown in FIG. 5(*f*) is similar to test body B, except that the cover resin 204 covers the aluminum electric wire tip part 202*a* to a border position between the wire barrel section 12 and the first transition 16.

Test samples including a copper-covered aluminum core wire 205 instead of the aluminum core wire 204 (G through L) were produced. As the copper-covered aluminum core wire 205, a copper-clad aluminum wire (CCA) produced by a clad method was used. Test body G shown in FIG. 6(*a*) has the following structure. A copper-covered aluminum electric wire tip part 205*a* exposed as a result of being stripped of the insulating cover 201 is covered with the cover solder 203, and is pressure-bonded and thus connected to the crimp terminal 10. The cover solder 203 covering the copper-covered aluminum electric wire tip part 205*a* is not in contact with the insulating cover tip part 201*a*, and covers the copper-covered aluminum electric wire tip part 205*a* to a position slightly away from the insulating cover tip part 201*a*.

Test body H shown in FIG. 6(*b*) has the following structure. The copper-covered aluminum electric wire tip part 205*a* is covered with the cover solder 203 and the cover resin 204, and is pressure-bonded and thus connected to the crimp terminal 10. The cover solder 203 and the cover resin 204 permeate into an area inner with respect to the insulating cover tip part 201*a*, and the cover resin 204 covers the copper-covered aluminum electric wire tip part 205*a* to a position around the center of the second transition 17.

Test body I shown in FIG. 6(*c*) is similar to test body G, except that the cover solder 203 permeates into an area inner with respect to the insulating cover tip part 201*a*. Test body J shown in FIG. 6(*d*) is similar to test body H, except that the cover resin 204 covers the copper-covered aluminum electric wire tip part 205*a* to a border position between the wire barrel section 12 and the second transition 17.

Test body K shown in FIG. 6(*e*) is similar to test body H, except that the cover resin 204 covers the copper-covered aluminum electric wire tip part 205*a* to a position around the center of the wire barrel section 12. Test body L shown in FIG. 6(*f*) is similar to test body H, except that the cover resin 204 covers the copper-covered aluminum electric wire tip part 205*a* to a border position between the wire barrel section 12 and the first transition 16.

Comparative test body A, although not shown, has the following structure. The cover solder 203 covering the aluminum electric wire tip part 202*a* is not in contact with the insulating cover tip part 201*a*, and covers the aluminum electric wire tip part 202*a* to a position slightly away from the insulating cover tip part 201*a*. Because of this, a part of the aluminum electric wire tip part 202*a* which is between the cover solder 203 and the insulating cover tip part 201*a* is exposed.

Comparative test body B, although not shown, has the following structure. The copper-covered aluminum electric wire tip part 205*a* exposed as a result of being stripped of the insulating cover 201 is pressure-bonded and thus connected to the crimp terminal 10.

Comparative test body C, although not shown, has the following structure. A filler formed of a mixture of zinc and a synthetic resin is applied to an inner wall of the aluminum core wire 202 exposed as a result of being stripped of the insulating cover 201 (tip part of the electric wire) and a brass intermediate cap, and the aluminum core wire 202 is covered with the intermediate cap. The tip part of the aluminum core wire 202 which is covered with the intermediate cap is caulked to an open barrel-type terminal formed of tin-plated brass. Thus, the aluminum core wire 202 is pressure-bonded and thus fixed to the terminal (same structure as described in Japanese Laid-Open Patent Publication No. 2004-207172).

The initial low-voltage electric resistance of test bodies A through L and comparative test bodies A and B was measured. After this, a corrosion test and a test of measuring the resistance increasing value from the post-corrosion test low-voltage electric resistance were performed on these test bodies. The corrosion test was performed as follows. The above-mentioned opposite end of the core wire stripped of the insulating cover 201 was covered with covered with a tube formed of Teflon (registered trademark) (Teflon Tube ((registered trademark)) produced by Nichias Corporation). The Teflon tube was fixed by a PTFE tape to be water-proof. Then, as defined by JIS 22371, the test body was suspended in a sealed tank, and a saline solution of a temperature of 35° C., a salt concentration of 5 mass % and pH 6.5 to 7.2 was sprayed for 96 hours.

The effect confirming test including the corrosion test and the test of measuring the low-voltage electric resistance was performed on 20 samples for each standard. The resistance value and the galvanic corrosion state were measured and observed on all of the samples.

The low-voltage electric resistance was measured by use of a resistance meter (ACmΩHiTESTER3560; produced by Hioki E.E. Corporation) by a 4-terminal method. The wire barrel section 12 side of the box section 11 was set as a positive electrode, and the aluminum electric wire tip part 202*a* at the end of the aluminum core wire 202 opposite to the terminal and the copper-covered aluminum electric wire tip part 205*a* at the end of the copper-covered aluminum core wire 205 opposite to the terminal were each set as a negative electrode. The low-voltage electric resistance was measured at room temperature after drying.

The measured resistance value is considered to be a total of the resistances at the pressure-bonding points of the aluminum core wire 202 or the copper-covered aluminum core wire 205, of the crimp terminal 10, and of the wire barrel section 12. The resistance of the aluminum core wire 202 and the copper-covered aluminum core wire 205 is not ignorable. Therefore, the resistance of the aluminum core wire 202 or the copper-covered aluminum core wire 205 was subtracted from the measured resistance value, and the resultant value was set as the low-voltage electric resistance of the wire barrel section 12.

When all of the 20 samples had an initial resistance value of less than 1 mΩ, the test body was evaluated as "◎". When three or less of the 20 samples had an initial resistance value of 1 mΩ or more and less than 1.5 mΩ and the remaining samples had an initial resistance value of less than 1 mΩ, the test body was evaluated as "○". When more than three of the samples had an initial resistance value of 1 mΩ or more and less than 1.5 mΩ and the remaining sample(s) had an initial resistance value of less than 1 mΩ, the test body was evaluated as "Δ". When at least one of the 20 samples had an initial resistance value of 1.5 mΩ or more, the test body was evaluated as "x". Regarding the resistance increasing value after the corrosion test, the evaluation was made as follows. When all the 20 samples had a resistance increasing value of less than 1 mΩ, the test body was evaluated as "◎". When three or less of the 20 samples had a resistance increasing value of 1 mΩ or more and less than 3 mΩ and the remaining samples had a resistance increasing value of less than 1 mΩ, the test body was evaluated as "○". When more than three of the 20 samples had a resistance increasing value of 1 mΩ or more and less than 3 mΩ and the remaining sample (s) had a resistance increasing value of less than 1 mΩ, the test body was evaluated as "Δ". When at least one of the 20 samples had a resistance increasing value of 3 mΩ or more, the test body was evaluated as "x".

A vibration test was performed on test bodies A through L and comparative test bodies A and B. After this, the corrosion test and the test of measuring the low-voltage electric resistance were performed on these test bodies. The vibration test was performed under the conditions in conformity to JIS D1601 (4), "Sweep vibration endurance test". Specifically, the crimp terminal 10 was placed with the wire barrel section 12 being directed upward. The crimp terminal 10 was vibrated in one direction, i.e., the upward/downward direction, at an acceleration of 45 $m/s^2$, while the frequency was increased and decreased continuously at a uniform rate within the excitation frequency range of 20 to 200 Hz, over a test time period of 4 hours. The length of the electric wire was 100 cm, and an end of the electric wire opposite to the box section of the terminal was fixed to the excitation table. The vibration test was performed on the terminal itself with no other elements. For performing the corrosion test, the electric wire was cut short such that the length from the box section to the opposite end would be about 10 cm. The results of the effect confirming test are shown in Table 1.

TABLE 1

| | | | | | After corrosion test | |
|---|---|---|---|---|---|---|
| Test body No. | Core wire | Cover member | Initial low-voltage electric resistance | Resistance increasing value | Initial low-voltage electric resistance | Resistance increasing value |
| Test body A | Aluminum core wire | Solder | ○ | ○ | ○ | Δ |
| Test body B | | Solder/resin | ○ | ○ | ○ | ○ |
| Test body C | | Solder | ○ | ○ | ○ | ○ |
| Test body D | | Solder/resin | ○ | ◎ | ○ | ◎ |
| Test body E | | Solder/resin | ○ | ○ | ○ | ○ |
| Test body F | | Solder/resin | X | X | X | X |
| Comparative test body A | | Solder | ○ | X | ○ | X |
| Test body G | Copper-clad aluminum core wire | Solder | ○ | ○ | ○ | ○ |
| Test body H | | Solder/resin | ○ | ○ | ○ | ○ |
| Test body I | | Solder | ○ | ○ | ○ | ○ |
| Test body J | | Solder/resin | ○ | ○ | ○ | ○ |
| Test body K | | Solder/resin | ○ | ○ | ○ | ○ |
| Test body L | | Solder/resin | X | X | X | X |
| Comparative test body B | | None | ○ | X | ○ | X |

As shown in Table 1, based on the measurement of the initial low-voltage electric resistance, the following has been confirmed. When the aluminum electric wire tip part 202*a* or the copper-covered aluminum electric wire tip part 205*a* is covered with the cover solder 203, a conducting function is provided with certainty. However, when the cover resin 204 permeates into the entire area of the wire barrel section 12, the conductivity between the aluminum electric wire tip part 202*a* or the copper-covered aluminum electric wire tip part 205*a* and the wire barrel section 12 is lowered. As a result, a sufficient conducting function is not guaranteed.

Based on the measurement of the resistance increasing value after the corrosion test, it has been confirmed that when the aluminum electric wire tip part 202*a* or the copper-covered aluminum electric wire tip part 205*a* is covered with the cover solder 203 and/or the cover resin 204, generation of galvanic corrosion is prevented or suppressed and a sufficient conducting function is provided.

It has been confirmed that when the aluminum electric wire tip part 202*a*, or the copper-covered aluminum electric wire tip part 205*a*, in the vicinity of the insulating cover tip part 201*a* is covered with the cover resin 204, a sufficient effect of preventing galvanic corrosion and a sufficient conducting function are provided even after the vibration test.

A conceivable reason for this is the following. In the case where a small gap such as a crack or the like is made by vibration in a part of the cover solder 203 which is pressure-bonded by the wire barrel section 12, the effect of preventing galvanic corrosion is reduced. Nonetheless, when a part of the aluminum electric wire tip part 202*a* or the copper-covered aluminum electric wire tip part 205*a* which is in the vicinity of the insulating cover tip part 201*a* is covered with the cover resin 204, the durability against vibration is improved.

By contrast, in test bodies A and C in which a part of the aluminum electric wire tip part 202*a* which is in the vicinity of the insulating cover tip part 201*a* is not covered with the cover resin 204, the insulating cover tip part 201*a* contacts the cover solder 203. As a result, the insulating cover 201 is deteriorated due to the heat of the cover solder 203. Therefore, the effect of preventing the galvanic corrosion is reduced in the vicinity of the insulating cover tip part 201*a*.

The results of the corrosion test after the vibration test of test body C are better than those of test body A. A conceivable reason for this is the following. In test body C, the cover solder 203 permeates into the inside of the insulating cover 201. Therefore, even when the insulating cover tip part 201*a* is deteriorated, the effect of preventing galvanic corrosion by the cover solder 203 can be maintained.

The results of the corrosion test and also the results of the corrosion test after the vibration test of test body D are inferior to those of the other test bodies. A conceivable reason for this is the following. The border position between the cover solder 203 and the cover resin 204 matches the rear end position of the wire barrel section 12, which is significantly deformed. Due to the significant deformation of the wire barrel section 12, the border face between the cover solder 203 and the cover resin 204 is damaged.

Based on the results of the corrosion test after the vibration test, the following has been confirmed. When the copper-covered aluminum electric wire tip part 205*a* is covered with the cover solder 203 and/or the cover resin 204, generation of galvanic corrosion is prevented and a sufficient conducting function is provided.

However, in comparative test body B, after the corrosion test, aluminum of the copper-covered aluminum electric wire tip part 205*a* was exposed at the edge of the barrel section due to cracks, and the aluminum conductor was eluted. The effect of preventing galvanic corrosion is considered to be reduced for this reason.

In the crimp terminal 10 described above, the wire barrel pieces 13 of the wire barrel section 12 are generally rectangular when seen in a side view. Alternatively, as shown in FIG. 7(*a*), semicircular barrel pieces 13*a* having a convexed curved-edge (e.g., generally semicircular shape) when seen in a side view may be used.

Figures 7A, 7B:
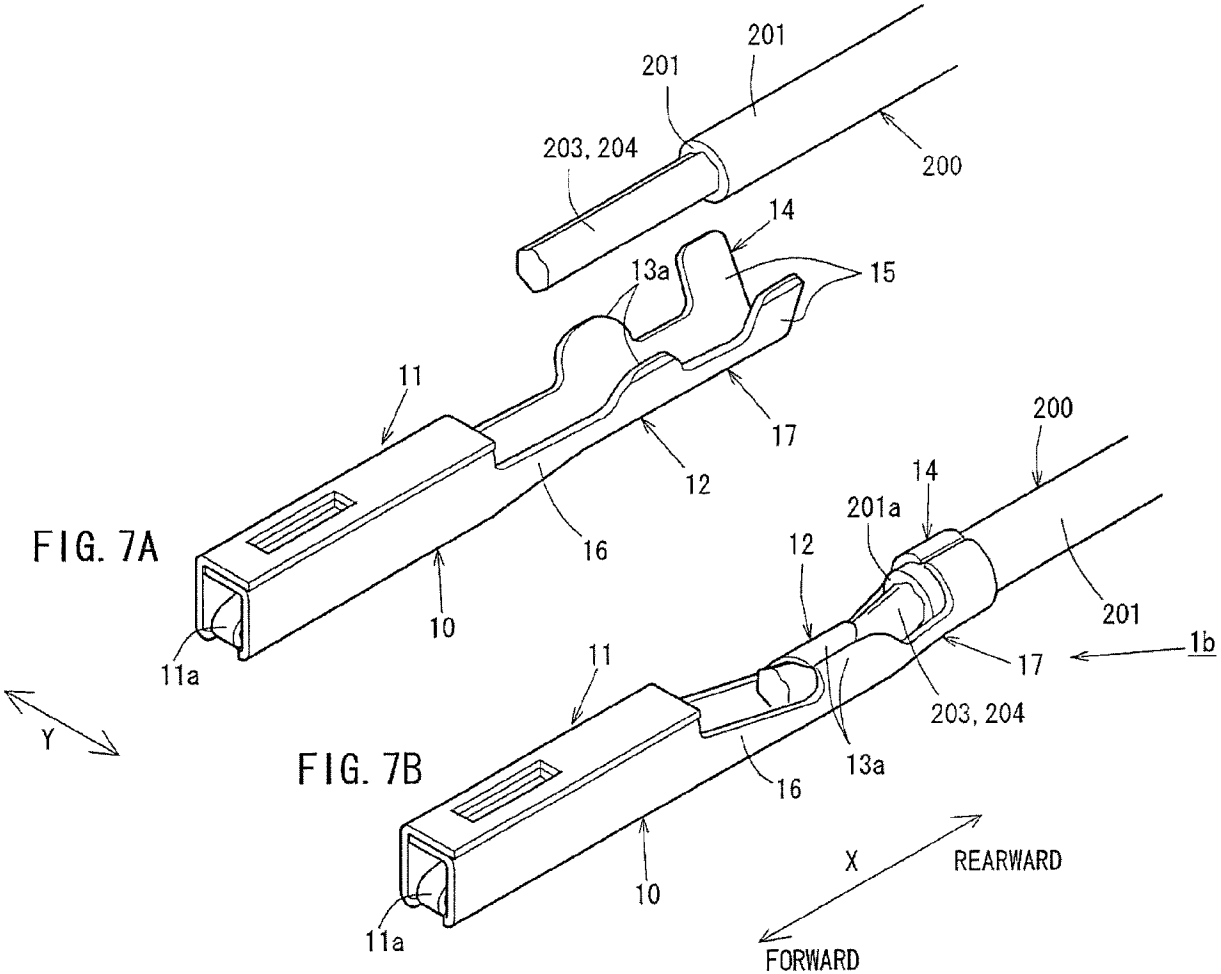
FIG. 7 shows a crimp terminal and a connection structural body in another example.

In a connection structural body 1*b* having such a structure, when the crimp terminal 10 is pressure-bonded to the aluminum electric wire tip part 202*a* or the copper-covered aluminum electric wire tip part 205*a* covered with the cover solder 203 and/or the cover resin 204, the cover solder 203 and/or the cover resin 204 is prevented from being cracked even when the semicircular barrel pieces 13*a* having a generally semicircular shape bite into the cover solder 203 and/or the cover resin 204 (see FIG. 7). Such a connection structural body 1*b* prevents or suppresses generation of galvanic corrosion, has a sufficient conducting function, and thus is highly durable.

An effect confirming test 2 was performed on the connection structural body 1*b* including the crimp terminal 10 which has the semicircular barrel pieces 13*a*. The results are shown in Table 2. For the corrosion test, the test body was suspended in a sealed tank, and a saline solution of a temperature of 35±5° C., a salt concentration of 5±1 mass %, a specific gravity of 1.0268 to 1.0423, and pH 6.5 to 7.2 was sprayed for 182 hours and 500 hours at a pressure of 68.6 to 176.5 kPa. The other test conditions and evaluation method are the same as those of the effect confirming test 1 described above.

TABLE 2

| Test body | 182 h | 500 h |
|---|---|---|
| Rectangular barrel pieces | ○ | Δ |
| Semicircular barrel pieces | ◎ | ◎ |

As shown in Table 2, the following has been confirmed. When the aluminum electric wire tip part 202*a* or the copper-covered aluminum electric wire tip part 205*a* is covered with the cover solder 203 and the cover resin 204, generation of galvanic corrosion is prevented or suppressed and a sufficient conducting function is provided in the case where the spraying time is 182 hours, regardless of whether the rectangular wire barrel pieces 13 is used or the semicircular wire barrel pieces 13*a* are used.

However, it has also been confirmed that in the case where the spraying time is 500 hours, when the rectangular wire barrel pieces 13 are used, the effect of preventing galvanic corrosion provided by the cover solder 203 and the cover resin 204 is reduced, and a sufficient conducting function is not guaranteed.

Based on the results of the effect confirming test 2 described above, it has been confirmed that the connection structural body 1*b*, including the semicircular barrel pieces 13*a* and having the aluminum electric wire tip part 202*a* or the copper-covered aluminum electric wire tip part 205*a* covered with the cover solder 203 and/or the cover resin 204, prevents or suppresses generation of galvanic corrosion and has a sufficient conducting function with a high level of durability.

Next, in order to increase the load on the insulating cover tip part 201*a*, which is the edge at which the electric wire is stripped of the insulating cover, a state where the crimp terminal 10 was not completely inserted into the cavity was assumed. Specifically, the crimp terminal 10 was set such that the entrance of the cavity would generally match the border face between the insulating cover tip part 201*a* and the cover solder 203. On test bodies A through E and G through K and comparative test body C, the vibration test was performed, and then the corrosion test was performed. The low-voltage electric resistance and the strength of the pressure-bonding section were measured (effect confirming test 3). The vibration test and the corrosion test were performed in substantially the same manner as in the effect confirming test 1, except that the terminal in the state of being inserted into the connector was used as each sample, not merely the terminal itself.

The effect confirming test 3 was performed on 20 samples for each standard. The resistance value and the galvanic corrosion state were measured and observed on all of the samples.

The low-voltage electric resistance was measured by use of a resistance meter (ACmΩHiTESTER3560; produced by Hioki E.E. Corporation) by a 4-terminal method. The wire barrel section 12 side of the box section 11 was set as a positive electrode, and the aluminum electric wire tip part 202*a* at the end of the aluminum core wire 202 opposite to the terminal and the copper-covered aluminum electric wire tip part 205*a* at the end of the copper-covered aluminum core wire 205 opposite to the terminal were each set as a negative electrode. The low-voltage electric resistance was measured at room temperature after drying.

The measured resistance value is considered to be a total of the resistances at the pressure-bonding points of the aluminum core wire 202 or the copper-covered aluminum core wire 205, of the crimp terminal 10, and of the wire barrel section 12. The resistance of the aluminum core wire 202 and the copper-covered aluminum core wire 205 is not ignorable. Therefore, the resistance of the aluminum core wire 202 or the copper-covered aluminum core wire 205 was subtracted from the measured resistance value, and the resultant value was set as the low-voltage electric resistance of the wire barrel section 12.

When all the 20 samples had a resistance increasing value of less than 1 mΩ, the test body was evaluated as "◎". When three or less of the 20 samples had a resistance increasing value of 1 mΩ or more and less than 3 mΩ and the remaining samples had a resistance increasing value of less than 1 mΩ, the test body was evaluated as "○". When more than three of the 20 samples had a resistance increasing value of 1 mΩ or more and less than 3 mΩ and the remaining sample (s) had a resistance increasing value of less than 1 mΩ, the test body was evaluated as "Δ". When at least one of the 20 samples had a resistance increasing value of 3 mΩ or more, the test body was evaluated as "x". The results of the test are shown in Table 3.

TABLE 3

| Test body No. | Core wire | Cover member | Resistance increasing value |
|---|---|---|---|
| Test body A | Aluminum core wire | Solder | Δ |
| Test body B | | Solder/resin | ○ |
| Test body C | | Solder | ○ |
| Test body D | | Solder/resin | ○ |
| Test body E | | Solder/resin | ○ |
| Test body G | Copper-clad aluminum core wire | Solder | ◎ |
| Test body H | | Solder/resin | ◎ |
| Test body I | | Solder | ◎ |
| Test body J | | Solder/resin | ◎ |
| Test body K | | Solder/resin | ○ |
| Comparative test body C | | Solder | X |

Based on the results of the effect confirming test 3, the following has been confirmed. Even when the load on the insulating cover tip part 201*a*, which is the edge at which the electric wire is stripped of the insulating cover, is increased, the cover solder 203 or the resin enters the inside of the insulating cover 201. Therefore, cracks or gaps are not formed. Generation of galvanic corrosion is prevented or suppressed, and a sufficient conducting function is provided.

On test bodies A through E and G through K and comparative test body C with a 10 cm-long electric wire, a thermal shock test (effect confirming test 4) was performed as follows. The test body was left at 120° C. for 15 minutes, and then left at −40° C. for 15 minutes in one cycle. This cycle was performed 5000 times. The low-voltage electric resistance was measured before and after the thermal shock test.

The low-voltage electric resistance was measured by use of a resistance meter (ACmΩHiTESTER3560; produced by Hioki E.E. Corporation) by a 4-terminal method. The wire barrel section 12 side of the box section 11 was set as a positive electrode, and the aluminum electric wire tip part 202*a* at the end of the aluminum core wire 202 opposite to the terminal and the copper-covered aluminum electric wire tip part 205*a* at the end of the copper-covered aluminum core wire 205 opposite to the terminal were each set as a negative electrode. The low-voltage electric resistance was measured at room temperature after drying.

Regarding the resistance increasing value of the low-voltage electric resistance, the evaluation was made as follows. When all the 20 samples had a resistance increasing value of less than 1 mΩ, the test body was evaluated as "◎". When three or less of the 20 samples had a resistance increasing value of 1 mΩ or more and less than 3 mΩ and the remaining samples had a resistance increasing value of less than 1 mΩ, the test body was evaluated as "○". When more than three of the 20 samples had a resistance increasing value of 1 mΩ or more and less than 3 mΩ and the remaining sample (s) had a resistance increasing value of less than 1 mΩ, the test body was evaluated as "Δ". When at least one of the 20 samples had a resistance increasing value of 3 mΩ or more, the test body was evaluated as "x". The results of the test are shown in Table 4.

TABLE 4

| Test body No. | Core wire | Cover member | Resistance increasing value |
|---|---|---|---|
| Test body A | Aluminum core wire | Solder | ◎ |
| Test body B | | Solder/resin | ◎ |
| Test body C | | Solder | ◎ |
| Test body D | | Solder/resin | ◎ |
| Test body E | | Solder/resin | ○ |
| Test body G | Copper-clad aluminum core wire | Solder | ◎ |
| Test body H | | Solder/resin | ◎ |
| Test body I | | Solder | ◎ |
| Test body J | | Solder/resin | ◎ |
| Test body K | | Solder/resin | ◎ |
| Comparative test body C | | Solder | X |

Based on the results of the effect confirming test 4, the following has been confirmed. Comparative test body C exhibits a significant resistance increase value due to the difference in the coefficient of expansion between the aluminum core wire 202 and the tin-plated brass material. By contrast, test bodies A through E and G through K maintain electric conductance owing to the existence of the cover solder 203.

Figure 8A:
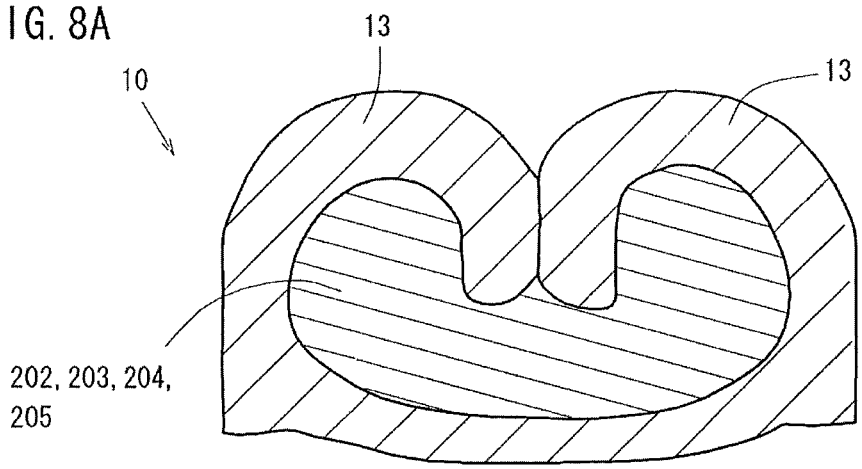
FIG. 8 provides cross-sectional views of a wire barrel section.
Figure 8B:
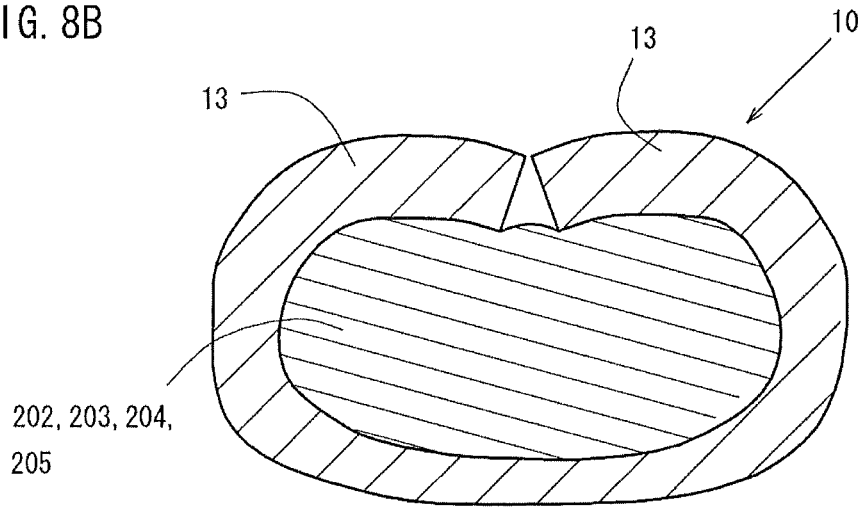

Even if the pressure-bonding state in the wire barrel section 12 is insufficient, such a state may be used as long as being practically usable. A pressure-bonding state which occurs when, for example, the developed length of the wire barrel piece 13 is short with respect to the cross-sectional area size of the conductor including the solder, the resin and the cover copper was assumed. Specifically, on test bodies A through E and G through K and comparative test body C, the thermal shock test (effect confirming test 5) was performed by use of the aluminum core wire 202 or the copper-covered aluminum core wire 205 having a cross-sectional area size of the conductor of 2 $mm^2$. FIG. 8(*a*) shows an example of sufficient pressure-bonding state, and FIG. 8(*b*) shows an example of pressure-bonding state which is insufficient as compared with that of FIG. 8(*a*) but is practically usable. The thermal shock test was performed in substantially the same manner as in the first effect confirming test 4. The results are shown in Table

TABLE 5

| Sample No. | Core wire | Cover member | Resistance increasing value |
|---|---|---|---|
| Sample A | Aluminum core wire | Solder | ○ |
| Sample B | | Solder/resin | ○ |
| Sample C | | Solder | ○ |
| Sample D | | Solder/resin | ○ |
| Sample E | | Solder/resin | ○ |
| Sample G | Copper-clad aluminum core wire | Solder | ◎ |
| Sample H | | Solder/resin | ◎ |
| Sample I | | Solder | ◎ |
| Sample J | | Solder/resin | ○ |
| Sample K | | Solder/resin | ○ |
| Comparative sample C | | Solder | X |

Based on the results of the effect confirming test 5, it has been confirmed that even when the pressure-bonding is not sufficient but is practically usable, test bodies A through E and G through K maintain electric conductance owing to the existence of the cover solder 203.

The aluminum electric wire according to the present invention corresponds to the aluminum core wire 202 or the copper-covered aluminum core wire 205 in the above-described embodiment; and in the same manner, the metal having a high potential corresponds to a copper alloy such as brass or the like, or tin plating performed on the surface of the terminal;

the resin corresponds to the cover resin 204;

an area from the insulating cover tip part to the rear end portion of the wire barrel section corresponds to the second transition 17;

the barrel piece corresponds to the wire barrel piece 13; and the curve-edged barrel piece corresponds to the semicircular barrel piece 13*a*.

However, the present invention is not limited to the above-described embodiment, and can be carried out in many other embodiments.

For example, the crimp terminal 10 is female in the above. The above-described effects can be provided when the insulated wire 200 is connected to a male terminal to form the connection structural body 1, 1*a* or 1*b*. The insulated wire 200 to be connected to the crimp terminal 10 is formed of the aluminum core wire 202 or the copper-covered aluminum core wire 205, which is liable to be galvanically corroded. Alternatively, the core wires 202 may be formed of any other metal conductor.

REFERENCE SIGNS LIST

1, 1*a*, 1*b* . . . Connection structural body
10 Crimp terminal
12 . . . Wire barrel section
13 . . . Wire barrel piece
13*a* . . . Semicircular wire barrel piece
16 . . . First transition
200 . . . Insulated wire
201 . . . Insulating cover
201*a* . . . Insulating cover tip part
202 . . . Aluminum core wire
202*a* . . . Aluminum electric wire tip part
203 . . . Cover solder
204 . . . Cover resin
205 . . . Copper-covered aluminum core wire
205*a* . . . Copper-covered aluminum electric wire tip part

The invention claimed is:

1. A connection structural body, comprising:

an aluminum electric wire tip part and a crimp terminal which are connected to each other;

wherein:

the aluminum electric wire tip part is an exposed tip part of an insulated wire including an aluminum electric wire and an insulating cover for covering the aluminum electric wire, and is exposed as a result of being stripped of a tip part of the insulating cover;

the crimp terminal includes a wire barrel section for pressure-bonding and thus connecting the aluminum electric wire tip part, and is formed of a metal material having a higher potential than that of a metal material used to form the aluminum electric wire;

the aluminum electric wire tip part is covered with a cover member formed of solder or formed of the solder and a resin; and the aluminum electric wire tip part is pressure-bonded and thus connected to the wire barrel section, such that the aluminum electric wire tip part is, in a pressure-bonded state, covered with the cover member, with no gap, from the tip part of the insulating cover to a rear end portion of the wire barrel section.

2. A connection structural body according to claim 1, wherein:

the aluminum electric wire is formed of a copper-covered aluminum electric wire; and the aluminum electric wire tip part is covered with copper and with the solder and/or the resin with no gap in a pressure-bonding state.

3. A connection structural body according to claim 2, wherein the cover member permeates into the aluminum electric wire inside the insulating cover.

4. A connection structural body according to claim 2, wherein the resin is formed of a hot-melt-type resin having a kinematic viscosity of 5000 to 20000 mPas at or in the vicinity of a melting point of the solder.

5. A connection structural body according to claim 1, wherein a barrel piece included in the wire barrel section is a curve-edged barrel piece having a convexed curve along an edge thereof.

* * * * *